United States Patent [19]

Baltz et al.

[11] Patent Number: 4,498,434

[45] Date of Patent: Feb. 12, 1985

[54] FUEL PRIMING SYSTEM WITH INTEGRAL AUXILLIARY ENRICHMENT FEATURE

[75] Inventors: Gene F. Baltz, Lake Villa, Ill.; Amos M. Clark, Kenosha, Wis.; David J. Hartke, Waukegan, Ill.; Donovan K. Jourdan, Kenosha, Wis.

[73] Assignee: Outboard Marine Corporation, Waukegan, Ill.

[21] Appl. No.: 508,943

[22] Filed: Jun. 29, 1983

[51] Int. Cl.[3] ..... F02N 17/00

[52] U.S. Cl. ..... 123/187.5 R; 261/DIG. 73

[58] Field of Search ..... 123/187.5 R, 187.5 P, 123/180 R, 180 P; 261/DIG. 73

[56] References Cited

U.S. PATENT DOCUMENTS

| | | | |
|---|---|---|---|
| 3,614,945 | 10/1971 | Schlagmuller et al. | 123/187.5 R |
| 4,286,553 | 9/1981 | Baltz et al. | 123/187.5 R |
| 4,373,479 | 2/1983 | Billingsley et al. | 123/187.5 R |
| 4,375,206 | 3/1983 | Baltz et al. | 123/187.5 R |

FOREIGN PATENT DOCUMENTS

| | | | |
|---|---|---|---|
| 0063120 | 12/1911 | Austria | 123/180 P |

*Primary Examiner*—Parshotam S. Lall

*Attorney, Agent, or Firm*—Michael, Best & Friedrich

[57] ABSTRACT

A system for priming and temporarily enriching the air/fuel mixture for a crankcase scavenged, two-cycle engine having a fuel pump supplying fuel to a carburetor for mixture with air for delivery to an induction manifold leading to the engine crankcase where it is compressed and transferred to the cyclinder combustion chamber through a passage, the system includes a solenoid valve controlled by a switch so the valve opens when the switch is turned on to start the engine. The valve inlet is connected to the fuel pump. The valve outlet is connected to a conduit means which is connected to the transfer passage to inject fuel to prime the engine. The valve outlet is also connected to a conduit connected to the induction manifold to enrich the air/fuel mixture therein. The fuel in conduits is drawn into the manifold after said valve closes to thereby enrich the air/fuel mixture long enough for the engine to warm up.

6 Claims, 2 Drawing Figures

FUEL PRIMING SYSTEM WITH INTEGRAL AUXILLIARY ENRICHMENT FEATURE

FIELD OF THE INVENTION

This invention relates to priming two-cycle engines and to enriching the air/fuel mixture after a cold start.

BACKGROUND OF THE INVENTION

There have been various proposals for ways to prime a two-cycle engine for starting purposes. These include injecting fuel into the transfer passage leading to the combustion chamber from the crankcase. Other proposals inject fuel into the manifold leading to the crankcase. The increased distance from the point of injection to the combustion chamber requires a longer time for the enriched air/fuel mixture to reach the combustion chamber.

SUMMARY OF THE INVENTION

This invention provides a system for priming the engine and temporarily enriching the air/fuel mixture in a crankcase scavenged, two-cycle engine having a fuel pump supplying fuel to a carburetor for mixture with air for delivery to an induction manifold leading to the engine crankcase where it is compressed and transferred to the cylinder combustion chamber through a passage. The system includes a solenoid valve controlled by a switch so the valve opens when the switch is turned on to start the engine, the valve inlet being connected to the fuel pump while the valve outlet is connected to a first conduit connected to the transfer passage to inject fuel to prime the engine. The valve outlet is also connected to a second conduit which is connected to the induction manifold to enrich the air/fuel mixture therein. The fuel in both conduits is drawn into said manifold after the valve closes.

A further feature of this invention is to provide a metering orifice at the outlet of each of the conduits.

Another feature of this invention is to connect the first conduit to the transfer passage of only one cylinder when the invention is applied to a multicylinder engine.

When the invention is applied to a multicylinder engine having multiple carburetors another feature of the invention is that the second conduit is connected to the induction manifold downstream of each carburetor.

An additional aspect of this invention is that the conduits on the outlet of the solenoid valve are sized to contain enough fuel to provide temporary enrichment of the air/fuel mixture after the engine starts and the valve closes to allow the engine to warm to operating temperature without additional priming.

This invention is not limited to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DETAILED DESCRIPTION OF THE DRAWINGS

Figure 1:
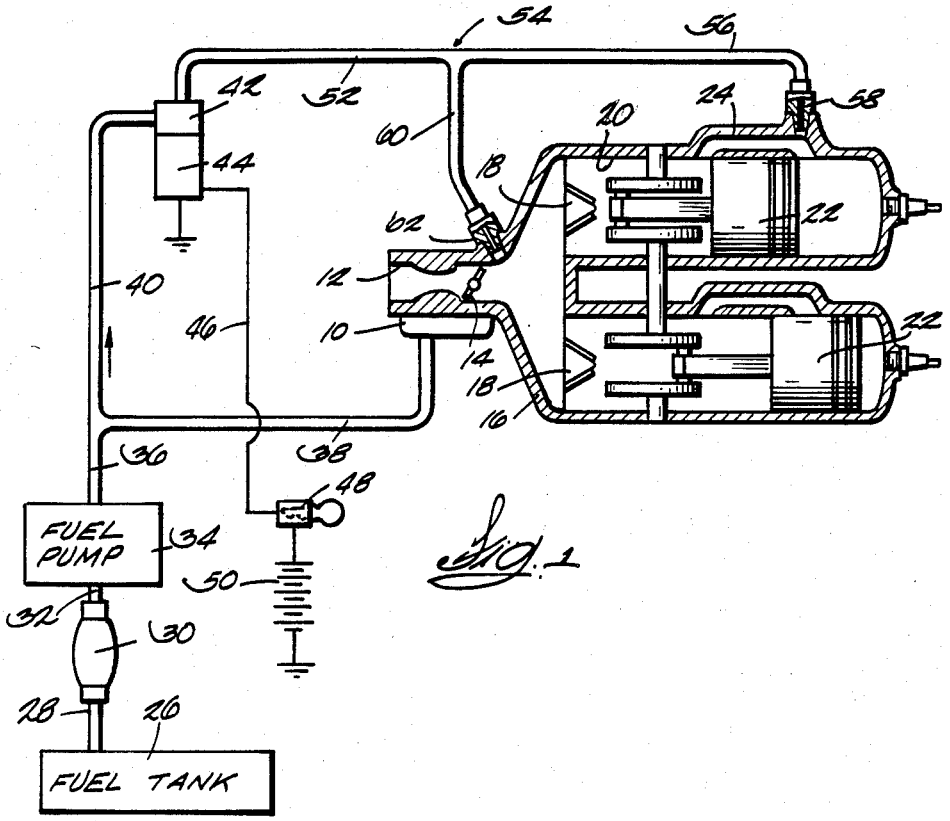
FIG. 1 is a schematic diagram illustrating the invention applied to a twin cylinder engine with a single carburetor.

FIG. 1 schematically illustrates portions of a twin cylinder, two-stroke crankcase scavenged engine. Air is drawn through carburetor 10 and venturi or throat 12 and fuel is drawn into the airstream in accordance with the vacuum at the venturi. The incoming fuel is vaporized in the airstream. The flow of the fuel/air mixture is controlled by throttle valve 14 and enters the induction or intake manifold 16. The mixture is drawn into each of the two crankcases 20 through respective reed-type check valves 18. The manner in which the air/fuel mixture is drawn into the crankcase 20 where it is compressed and transferred to the space above the piston 22 through the transfer passage 24 is all well known. Each cylinder has a transfer passage.

The fuel supply to the carburetor 10 comes from the fuel tank 26 with hose 28 leading to the manually operated fuel primer bulb 30. Hose 32 connects the bulb outlet to the fuel pump 34 which is operated by the pressure changes in the crankcase. The fuel leaving the fuel pump goes through hose 36 which leads to a Y with hose 38 going to the float chamber of carburetor 10 and hose 40 leading to the solenoid valve 42 operated by the coil 44. The coil is connected by wire 46 to ignition switch 48 connected to battery 50. When the switch 48 is turned "on" the engine will be cranked and the valve 42 will open.

The output of the solenoid valve 42 leads to a Tee 54 with one hose 56 leading to the induction transfer passage 24 of the upper cylinder in the drawing in FIG. 1. There is a fuel metering orifice 58 at the point of connection to the transfer passage 24. Another hose 60 leading from the Tee 54 is connected to the induction manifold 16 with a metering orifice 62 at the point of connection.

This arrangement will, therefore, supply raw fuel to the upper induction transfer passage and to the induction manifold. The induction manifold leads to both cylinders. With the additional input of fuel at this point, the air/fuel mixture will be enriched over that which normally passes through the carburetor. The enrichment compensates for poor vaporization in a cold engine which results in too lean a mixture.

When the key is turned "on" and the solenoid valve 42 opened, the hoses 52, 56, 60 will fill with gasoline very fast and this then will cause fuel to be injected into the transfer passage and into the induction manifold as indicated. The fuel injected at the transfer passage is virtually injected directly into the cylinder. Therefore, there is no delay in getting fuel to the cylinder and the engine will start virtually on the first revolution. There is no wait for an enriched air/fuel mixture to be drawn into the crankcase and then transferred to the combustion chamber. The engine starts practically instantly. In the meantime, fuel is being injected into the induction manifold. Hoses 52, 56 60 are full of fuel. When the engine starts and the operator turns the primer switch "off" valve 42 will close. Each of the metering orifices 58, 62 is calibrated to provide correct flow for starting and warm-up. Pressure in the transfer passage is positive relative to the induction manifold pressure which is negative. Therefore, the fuel in the lines 52, 56, 60 will be pumped or drawn into the induction manifold at a rate determined by the size of the metering orifice 62. The amount of fuel in the lines depends on the length of the lines and the inside diameters of the lines. The time it will take to draw this fuel into the induction manifold is determined by the size of the orifice 62 relative to the "resevior" in the hoses 52, 56, 60. This can be sized to obtain fuel injection at the induction manifold through the orifice 62 for about ½ minute which will provide enough enrichment of the mixture coming through the carburetor to allow the engine temperature to get high enough so that enrichment is no longer required. Thus, the disclosed construction not only primes the engine for instant starting, but also enriches the air/fuel supply long enough to eliminate the need for additional priming.

Figure 2:
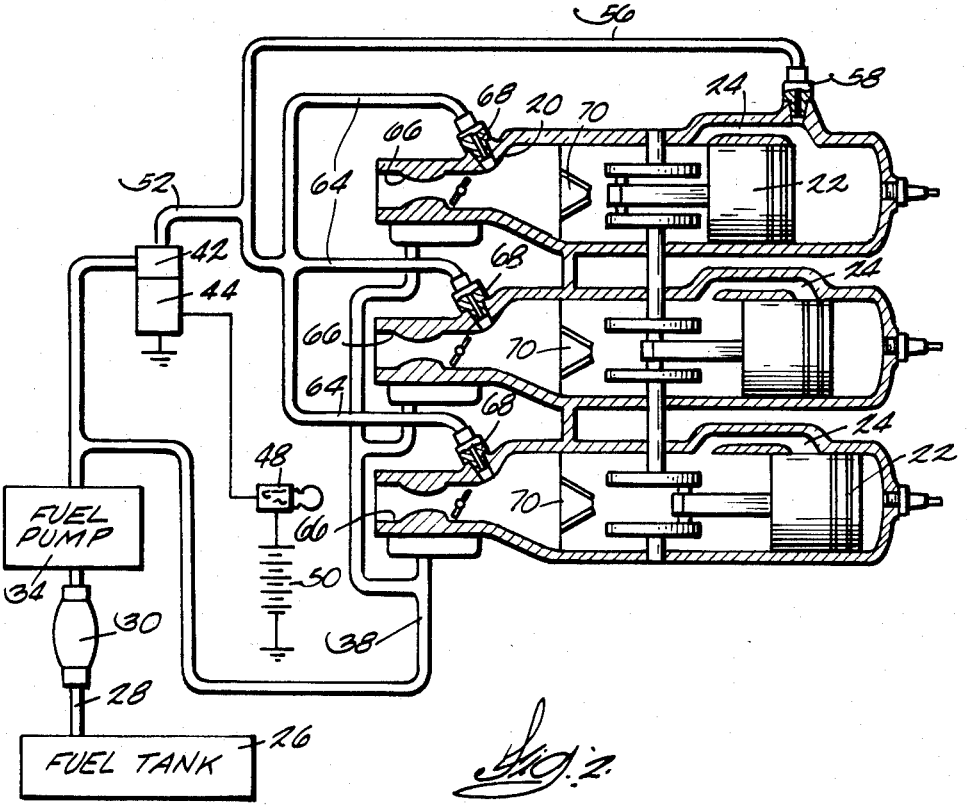
FIG. 2 is a similar schematic representation but in this case shows the invention applied to a multicylinder engine with multiple carburetors.

It should be noted that the fuel is injected into only one induction transfer passage. That will be sufficient to start the engine. This is true even in the multicylinder (three cylinder) arrangement shown in FIG. 2. In FIG. 2 similar parts bear the same reference numbers as in FIG. 1. Inspection of FIG. 2 will quickly demonstrate that even with three cylinders, fuel is injected only into one cylinder. Only the transfer passage for the top cylinder has fuel injected. Fuel is supplied to the metering orifice 58 through hose 56 connected to hose 52 leading from the outlet of valve 42.

Three hoses 64 connect hose 52 to each of manifolds downstream of carburetors 66. Each hose is provided with metering orifice 68 at the point of connection to the induction manifold. Each induction manifold is short and leads to a reed-type check valve 70 on the intake to the crankcase of the engine. The hoses 64 are sized so that the "reservoir" in each hose plus a proportionate share of the fuel in hose 52 and hose 56 will be about the same so that each intake manifold will be provided with approximately the same amount of fuel after the ignition switch 48 is turned off. This is designed to provide the engine an enriched fuel supply for approximately 30 seconds. As noted, even with three cylinders, priming of only one of the cylinders at the transfer passage will be enough to get the instant start. Then the engine will run on with the enriched fuel supply for however long the designer feels appropriate. There is no critical time. With this arrangement there is no need for a choke. In effect, after the solenoid valve 42 is closed, the reservoir of fuel in the hoses is vented through the orifice 58 leading to the induction transfer passage. It becomes a vent to the system so the intake manifold vacuum is not drawing liquid out of a "reservoir" with no vent.

We claim:

1. A crankcase scavenged, two-cycle engine comprising a manifold adapted to be connected to a carburetor for receiving therefrom a fuel/air mixture, a crankcase connected to said manifold for receiving therefrom the fuel/air mixture, a check valve between said manifold and said crankcase for preventing fluid flow from said crankcase to said manifold and permitting fluid flow from said manifold to said crankcase, a combustion chamber extending from said crankcase, a transfer passage communicable between said crankcase and said combustion chamber for transferring the fuel/air mixture from said crankcase to said combustion chamber, a normally closed valve adapted to be connected to a source of fuel and including an outlet, a first conduit communicating between said outlet and said transfer passsage, a second conduit communicating between said outlet and said induction manifold, and means connected to said valve for selective opening thereof.

2. An engine according to claim 1 and further including a metering office at the outlet of each of said conduits.

3. An engine according to claim 1 wherein said engine includes a second combustion chamber and wherein said first conduit is connected only to said transfer passage communicable with said first-mentioned combustion chamber.

4. An engine according to claim 1 wherein said engine includes a plurality of said combustion chambers, a like plurality of said crankcases, and a like plurality of said transfer passages respectively communicable between said crankcases and said combustion chambers, and wherein said engine further includes a like plurality of said manifolds, and a like plurality of said check valves respectively connected between said manifolds and said crankcases, and wherein said engine further includes a like plurality of said carburetors each including a throttle and respectively communicating with said plurality of manifolds, and wherein said second conduit communicates with each of said manifolds between said throttles and said check valves.

5. An engine according to claim 1 wherein said first and second conduits have a length sufficient to provide a reservoir for supplying to said manifold an enriching air/fuel mixture for a sufficient period after closure of said valve to enable the engine to reach an operating temperature.

6. A crankcase scavenged, two-cycle engine comprising a fuel pump adapted to be connected to a source of fuel, a carburetor connected to said fuel pump for receiving therefrom fuel and adapted for mixing the fuel with air to obtain a fuel/air mixture, a manifold connected to said carburetor for receiving therefrom the fuel/air mixture, a crankcase connected to said manifold for receiving therefrom the fuel/air mixture, a combustion chamber extending from said crankcase, a check valve between said manifold and said crankcase for preventing fluid flow from said crankcase to said manifold and permitting fluid flow from said manifold to said crankcase, a transfer passage communicating between said crankcase and said combustion chamber for transferring the fuel/air mixture from said crankcase to said combustion chamber, a normally closed solenoid valve having an inlet connected to said fuel pump and having an outlet, a first conduit communicating between said solenoid valve outlet and said transfer passage, a second conduit communicating between said solenoid valve outlet and said induction manifold, and a switch connected to said solenoid valve for opening thereof in response to switch actuation whereby, when said switch is temporarily actuated, said fuel pump supplies priming fuel through said first and second conduits to said transfer passage and said manifold, and, when said solenoid valve closes after actuation of said switch, fuel in said first and second conduits is supplied to said manifold by reason of the pressure differential between said transfer passage and said manifold.

* * * * *